US007351749B2

(12) United States Patent
Divone et al.

(10) Patent No.: US 7,351,749 B2
(45) **Date of Patent: *Apr. 1, 2008**

(54) PROCESS FOR MANUFACTURE OF PERSONAL CARE PRODUCTS UTILIZING A CONCENTRATE WATER PHASE

(75) Inventors: Peter Anthony Divone, New York, NY (US); Walter Anthony Biercevicz, Prospect, CT (US); Joseph James Regan, Naugatuck, CT (US); Christy Ann Bridges, Fairfield, CT (US); Kimberly Ann Priest, Hamden, CT (US); Matthew Jungblut, Lombard, IL (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 938 days.

This patent is subject to a terminal disclaimer.

(21) Appl. No.: 10/320,029

(22) Filed: Dec. 16, 2002

(65) Prior Publication Data

US 2004/0115230 A1 Jun. 17, 2004

(51) Int. Cl.
*B01F 3/08* (2006.01)

(52) U.S. Cl. ..... 516/54; 516/929

(58) Field of Classification Search ..... 424/401, 424/47, 400; 514/844; 516/36, 54, 929–931; 137/3, 7, 12, 14

See application file for complete search history.

(56) References Cited

U.S. PATENT DOCUMENTS 1,984,595 A * 12/1934 Pfening et al. ..... 137/551
3,176,964 A * 4/1965 Cottell et al. ..... 366/119
3,481,350 A * 12/1969 Chamberlain ..... 137/3
3,926,413 A 12/1975 D'Urso
3,997,080 A * 12/1976 Langstroth ..... 222/61
4,405,489 A * 9/1983 Sisbarro ..... 516/109
4,446,127 A 5/1984 Bucheler et al.
4,495,086 A * 1/1985 Hiroshima et al. ..... 516/20
4,839,093 A * 6/1989 Wenmaekers ..... 516/38

(Continued)

FOREIGN PATENT DOCUMENTS

DE 30 28 005 A1 7/1980

(Continued)

OTHER PUBLICATIONS

Remington's Science and Practice of Pharmacy, 19th Edition, 1995.*

(Continued)

*Primary Examiner*—Sharon E. Kennedy
(74) *Attorney, Agent, or Firm*—Milton L. Honig

(57) ABSTRACT

A process which may be continuous is provided for manufacture of personal care product compositions. The process involves feeding a first water phase which is a concentrate containing most if not all water soluble ingredients of the composition into a blending tube. A second phase which can be oily or aqueous and a third water phase, the latter being essentially pure water, are also fed into the blending tube. All of the phases are transported through the tube at a flow rate of about 5 to about 5,000 lbs./minute and at a pressure of about 10 to about 5,000 psi. Preferably the tube leads into a homogenizer such as a sonolator.

10 Claims, 2 Drawing Sheets

U.S. PATENT DOCUMENTS

| | | | | |
|---|---|---|---|---|
| 5,006,349 | A | 4/1991 | Dahlstrom et al. | |
| 5,304,334 | A * | 4/1994 | Lahanas et al. | 516/23 |
| 5,439,020 | A * | 8/1995 | Lockhart | 137/3 |
| 5,674,511 | A * | 10/1997 | Kacher et al. | 424/401 |
| 5,837,272 | A * | 11/1998 | Fierro et al. | 516/107 |
| 5,948,855 | A * | 9/1999 | Lin et al. | 524/837 |
| 5,996,650 | A * | 12/1999 | Phallen et al. | 141/83 |
| 6,126,948 | A | 10/2000 | Simonnet et al. | |
| 6,447,556 | B1 | 9/2002 | Cemenska et al. | |
| 6,515,030 | B1 * | 2/2003 | Bechtel et al. | 516/58 |
| 7,109,268 | B2 * | 9/2006 | Creutz et al. | 524/588 |
| 2001/0018068 | A1 * | 8/2001 | Lorenzi et al. | 424/443 |
| 2001/0051204 | A1 * | 12/2001 | Cornelis et al. | 426/580 |
| 2002/0061330 | A1 * | 5/2002 | Chowdhary et al. | 424/450 |
| 2003/0086895 | A1 * | 5/2003 | Hanes et al. | 424/70.17 |
| 2005/0058680 | A1 | 3/2005 | Binder et al. | |

FOREIGN PATENT DOCUMENTS

| | | |
|---|---|---|
| DE | 31 00 322 | 1/1981 |
| DE | 198 14 267 | 9/1997 |
| DE | 197 51 762 | 11/1997 |
| EP | 0 279 641 | 2/1988 |
| WO | 03/082220 A2 | 10/2003 |

OTHER PUBLICATIONS

Only English-Translated/Written Patents Reviewed.
Opposition by P&G.
Opposition by Beiersdorf.
Publication from Sonic Corporation, entitled "ultrasonic mixing".
Publication from Sonic Corporation, entitled "fibersonic systems".
Publication from Sonic Corporation, entitled "Dual Feed Sonolation".
Drug & Cosmetic Catalog, 1983.
Eastman AQ 38S Polymer raw material—from Eastman Chemical Company's website.
Information taken from CFTA website relating to polyester-5.
Information taken from CFTA website relating to glycerin.
Information taken from CFTA website relating to Xanthan gum.

* cited by examiner

PROCESS FOR MANUFACTURE OF PERSONAL CARE PRODUCTS UTILIZING A CONCENTRATE WATER PHASE

BACKGROUND OF THE INVENTION

1. Field of the Invention

The invention concerns a process for manufacture of liquid personal care products which minimize equipment requirements, increase capacity and reduce manufacturing times.

2. The Related Art

Among the most widely used personal care products of the liquid type are shampoos, shower gels and skin lotions. Ordinarily each of these products are marketed in a variety of colors with different fragrances and promotional ingredients. More efficient ways are continuously being sought for their manufacture.

Particularly sought are systems which can minimize equipment, increase capacity and reduce formulation time.

SUMMARY OF THE INVENTION

A process for manufacture of personal care compositions is provided which includes:

(i) feeding a first water phase having a viscosity from about 50 to about 30,000 cps into a blending tube;

(ii) feeding a second phase into the blending tube;

(iii) feeding a third phase having a viscosity of less than 30 cps into the blending tube, the third phase being at least about 15% of the composition;

(iv) mixing together all three of the phases, each of the phases being pumped into the blending tube as a liquid stream at a pressure from about 10 to about 5,000 psi and at a flow rate of about 5 to about 5,000 pounds per minute; and (v) recovering a resultant mixture as a personal care composition.

BRIEF DESCRIPTION OF THE DRAWING

Advantages and features of the present invention will become more readily apparent from consideration of the drawing in which.

DETAILED DESCRIPTION OF THE INVENTION

Now it has been found that significant manufacturing efficiencies can be achieved for the production of personal care compositions. The advance is based upon a first water phase concentrate incorporating most of any water soluble ingredients found in the final personal care composition. The concentrate is then blended with a second phase. Where the eventual personal care composition is an emulsion such as a skin cream, the second phase will be an oil phase. Other products such as shampoos which do not contain an oil phase, will be manufactured with a second phase that is aqueous and formulated with one or more surfactants. A third phase provides additional water. Normally the third phase will be purely water but sometimes it may carry a minor amount of further ingredients.

All three phases are blended in a tube. For purposes of this invention, the term "blending tube" may include any chamber, vessel and piping wherein all three phases come together for mixing. Ordinarily the volume of the blending tube will be relatively small. The volume may range from about 0.0001 to about 100 cubic inches, preferably from about 0.001 to about 20 cubic inches, more preferably from about 0.01 to about 5 cubic inches, and optimally from about 0.1 to about 1 cubic inch.

Even though much of the water is eliminated from the first water phase concentrate, most water-soluble ingredients can still be placed into solution or suspended. The benefit is found with the holding/blending tank which can be significantly downsized from the traditional non-concentrate process. Less mixing equipment is necessary and less tank space is required. Top-off water in the form of an additional water (third) phase reconstitutes the concentrate at the point of mixing. No holding tanks or mixers are ordinarily necessary for preparing the third (water) phase. This phase may be directly pumped into the blending tube from any water source such as a well or municipal water carrier.

Viscosities of the first water phase concentrate will be much higher than that of the third (water) phase. More specifically, the first water phase will have a viscosity ranging from about 50 to about 30,000 cps, preferably from about 150 to about 20,000 cps, optimally from about 300 to about 5,000 cps as measured on a Brookfield RVT Viscometer, Spindle No. RV6 at 20 rpm for 1 minute at 25° C.

The third (water) phase ordinarily will have virtually no other additives. Viscosity of this phase is usually Less than 5 cps, preferably from about 1 to 4 cps, as measured on a Brookfield RVT Viscometer, Spindle No. RV6 at 20 rpm for 1 minute at 25° C.

Figure 1:
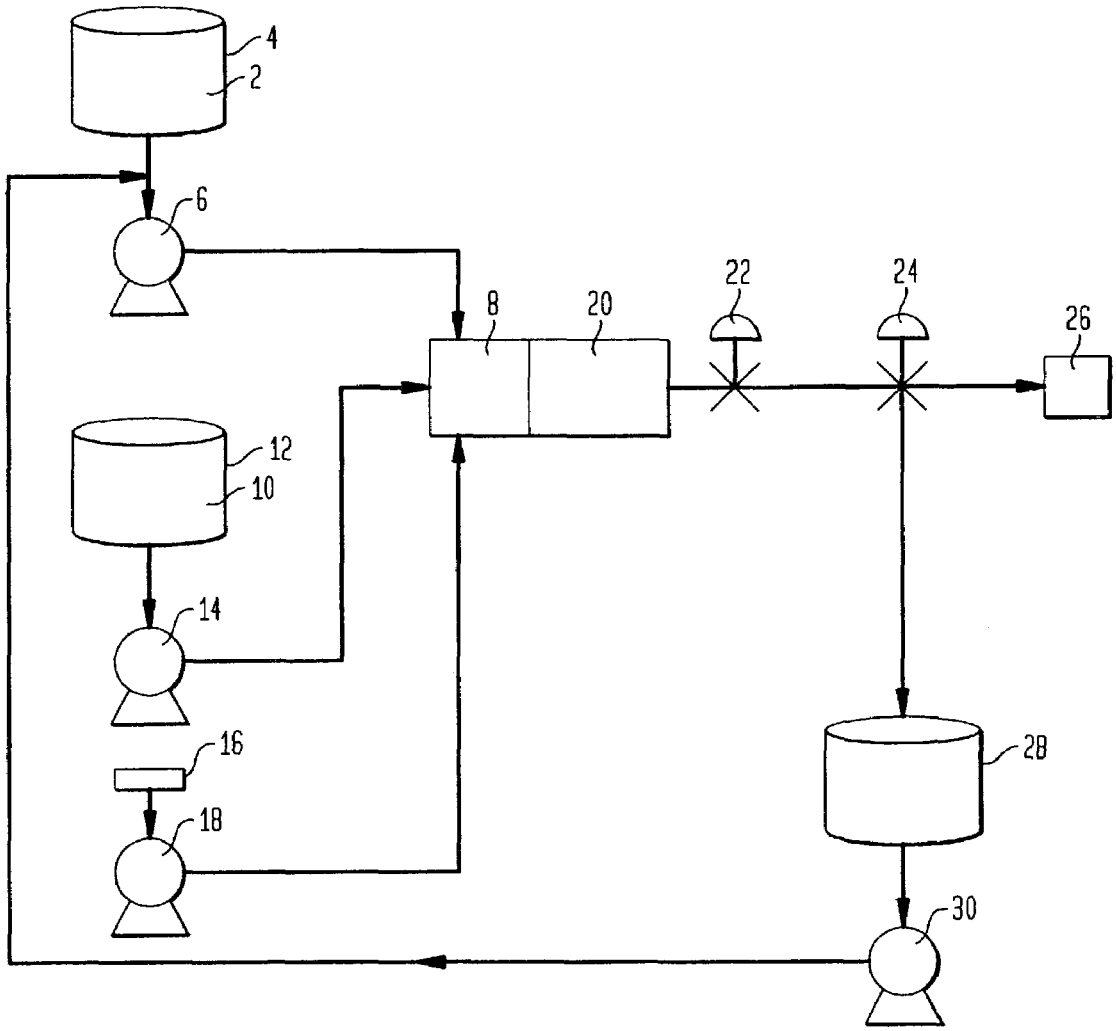
FIG. 1 is a schematic of a first embodiment according to the present process.

FIG. 1 is a schematic flow diagram of the process according to the present invention. A concentrated first water phase 2 is formulated within a tank 4. Reconstitution of the concentrate may require anywhere from two to fifty times the amount of pure water by weight to achieve the desired composition. The first phase is delivered via a pump 6 through piping to a blending tube 8.

A second phase 10 is held within tank 12. Often when the intended composition is a skin care product, formulation will be an emulsion requiring a water and oil phase. In this instance, the second phase will be an oil phase. Products such as shampoos and shower gels often do not require an oil phase. For these types of products, the second phase will be aqueous and usually deliver one or more surfactants. The levels of surfactants in shampoos and shower gets generally are well above 10%. Consequently, these types of products may utilize an aqueous second phase which can include total surfactant levels ranging from about 15 to about 90%, preferably from about 25 to about 75% by weight of the second phase.

Delivery of the second phase into the blending tube is mediated by a pump 14. Typical pumps can be Triplex Cat or Progressive Cavity Pumps (ex Moyno/Seepex).

A third phase 16 normally constituted only by water, but occasionally may have a few additives, is also fed into the blending tube. Transfer is facilitated by a pump 18. The latter may be a Moyno/Seepex Progressive Cavity pump, a Waukesha or Positive Displacement pump.

Subsequent to leaving blending tube 8, the combination of phases 2, 10 and 16 enter a Sonolator® 20 which operates as a homogenizer thoroughly mixing all phases together under high pressure and shear. The resultant fluid is then transmitted through a back pressure valve 22. Downstream a 3-way valve 24 leads most of the product to a storage tank or directly to a package filler 26. Normally a small amount of product is diverted via the 3-way valve into re-work reservoir 28 for recycling via pump 30 into the stream of the first phase. Amounts of rework may range from 0 to 50%, preferably from 1 to 20%, optimally about 5% of total product that has exited the sonolator from the blending tube.

Typically the process involves formation of a first water phase in a first reactor wherein components are mixed and maintained at a temperature from about 10 to about 70° C., preferably from about 18 to about 58° C., optimally from about 24 to about 52° C. In most but not all instances it will be preferable to have the first water phase at a temperature at least about 5° C., preferably at least about 11° C., cooler than the second phase (especially where this is oil) at point of mutual blending.

The second phase will be formed in a reactor by mixing components at a temperature ranging from about 10 to about 150° C., preferably from about 40 to about 165° C., optimally from about 66 to about 95° C.

The third phase can be maintained at a temperature from about 0 to about 57° C., preferably from about 5 to about 45° C., optimally from about 15 to about 38° C.

Viscosities of the second phase as measured with a Brookfield RVT Viscometer, Spindle No. RV6 at 20 rpm for 1 minute at 25° C., may range from about 50 to about 200,000 cps, preferably from about 1,000 to about 100,000, optimally from about 5,000 to about 50,000 cps.

Viscosities of the final personal care products normally may range between about 1,000 and about 30,000 cps, preferably between about 5,000 and about 30,000 cps, and optimally between 10,000 and 25,000 cps using the Brookfield RVT Viscometer, Spindle No. RV6 at 20 rpm for 1 minute at 25° C.

Deliveries of fluids from tanks containing the first and second phases into the blending tube 8 can be achieved through a pair of electronically controlled servo-driven rotary pumps. Careful control of flow is achieved by use of blending valves available from the Oden Corporation monitored by E&H mass flow meters. The equipment may include static mixing elements and back-pressure valves.

Flow rate for the first water phase and second phase into blending tube 8 may range from about 5 to about 5,000 lbs. per minute. Preferably flow rate may range from about 50 to about 1,000 lbs. per minute, and optimally from about 150 to about 800 lbs. per minute.

Geometry of the blending tube 8 should be such that residence time of the blended first, second and third phases may range from about 0.0001 seconds to about 5 minutes, preferably from about 0.001 to about 120 seconds, optimally from about 0.01 to about 10 seconds.

In systems where the second phase is an oil, temperature of the emulsion in blending tube 8 normally should be less than the temperature of the second (oil) phase as the latter leaves its reactor tank. Typical emulsion temperatures within the blending tube 8 may range from about 10 to about 82° C., preferably from about 27 to about 65° C., optimally from about 35 to about 55° C.

In a preferred embodiment, oil and both water (first and third) phases are pumped at relatively high pressures which may range from about 10 to about 5,000 psi, preferably from about 100 to about 1000 psi, and optimally from about 150 to about 250 psi.

In one embodiment of the present invention, oil and first water phases are transferred from their respective reactors through a positive displacement feed pump such as a Waukesha PD Gear Pump. Thereafter each of the separate phases are delivered through a high pressure pump such as a triplex plunger type available from the Giant Corporation, Toledo, Ohio or from the Cat Corporation. From there, each of the separate water and oil phases are fed into the blending tube 8 which in a preferred embodiment is a Sonolator® available from the Sonic Corporation, unit of General Signal. The Sonolator® is an in-line device capable of converting the kinetic energy of a high velocity stream of liquid into a high intensity mixing action. Conversion is accomplished by pumping the liquid through an orifice against a blade-like obstacle immediately in the jet stream of the liquid. The liquid itself oscillates in a stable vortexing pattern, which in turn causes the blade-like obstacle to resonate, resulting in a high level of cavitation, turbulence and shear. The blade or knife is brought into an ultrasonic vibration by the fluid motion which causes cavitation in the liquid.

Alternative high-pressure fed homogenizers other than the sonolator are the Manton Gaulin type homogenizer available from the APV Manton Corporation and the Microfluidizer available from Microfluidics Corporation. These type high pressure homogenizers contain a valve which is pressed (hydraulically or by a spring) against a fixed valve seat. Under high pressure, fluid flows through the opening in the seat and then through a gap between the valve and seat. Although geometries of different high pressure homogenizers may differ in details, and may even be roughened with sharp edges, they all are generally similar. Often the high pressure homogenizer may consist of two or more valve-seat combinations.

Weight ratios of the first water phase (concentrate) to the third (water) phase will be dependent upon the type of personal care composition and particular formulation ingredients. The weight ratio may range from about 1:1 to about 1:40, preferably from about 1:1 to about 1:10, optimally from about 1:1 to about 1:6.

The first water phase and second phase are present in a weight ratio ranging from about 50:1 to about 1:50, preferably from about 10:1 to about 1:10.

Ordinarily the third phase will be constituted solely of water. However, in certain instances this phase may contain a small amount of additives. Normally the amount of those additives will constitute no more than 10%, preferably no more than 5%, optimally no more than 2% by weight of the third phase. By contrast, the first water phase (concentrate) can generally include more than 5%, preferably more than 10%, most preferably more than 15%, and optimally more than 40% by weight of the concentrate of ingredients other than water.

Figure 2:
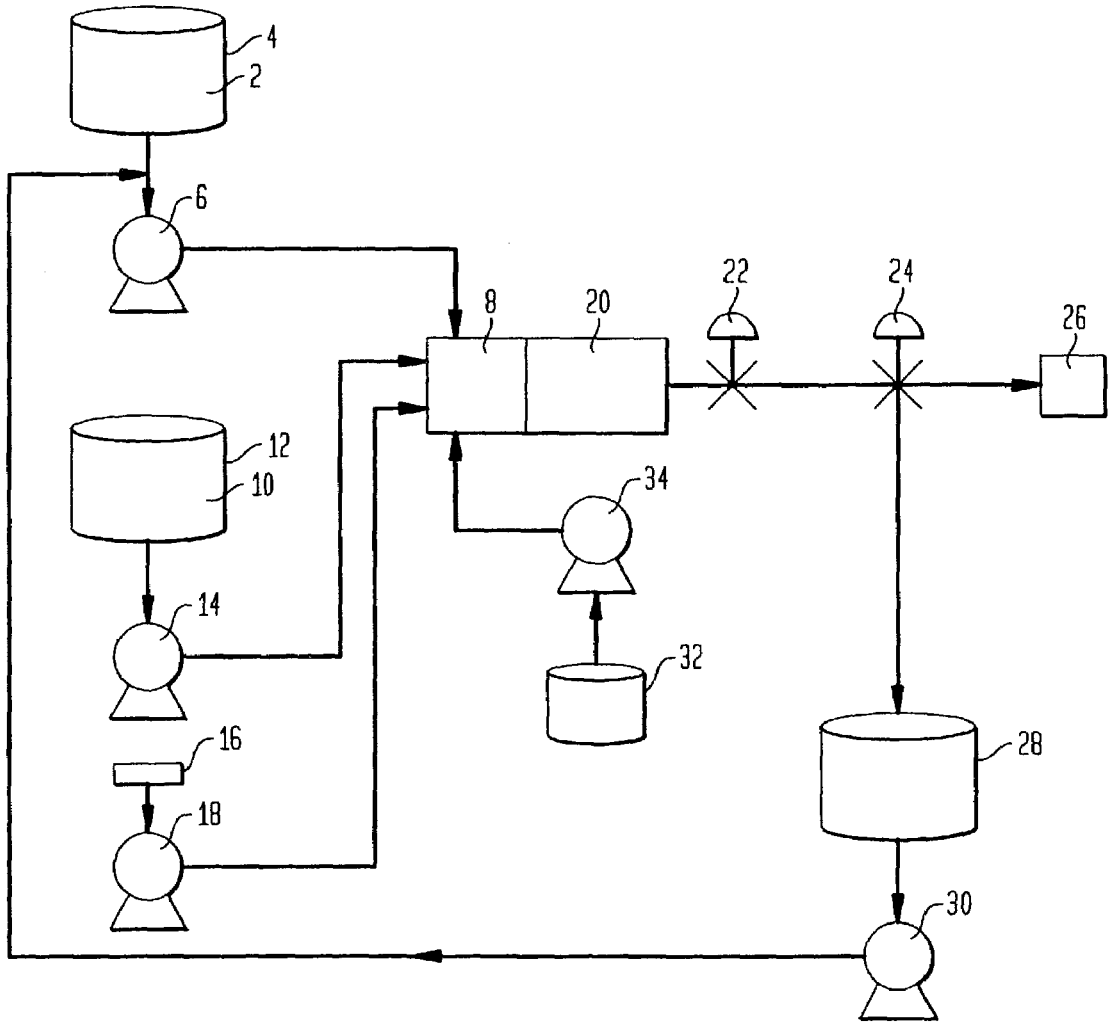
FIG. 2 is a schematic of a second embodiment according to the present process.

FIG. 2 illustrates a slightly modified process from the one described by FIG. 1. The modification involves addition of a thickener in water as a fourth phase 32 via a pump 34 into the blending tube. Ordinarily, thickeners can be formulated via the first phase. However, some types of final product are required to be exceptionally viscous. For those instances, a separate phase is found to be more efficient for incorporating relatively large amounts of a thickener.

Personal care compositions according to this invention may include shampoos, shower gels, liquid hand cleansers, liquid dental compositions, skin lotions and creams, hair colorants, facial cleansers, and impregnated fluids absorbed on wiping articles.

Generally the first phase and/or the second phase will contain a surfactant. Useful surfactants include nonionic, anionic, cationic, amphoteric, zwitterionic and surfactant combinations thereof. Overall amount of surfactant may range from about 0.1 to about 50%, preferably from about 2 to about 40%, optimally from about 15 to about 25% by weight of the total personal care composition.

Illustrative but not limiting examples of suitable nonionic surfactants include $C_{10}$-$C_{20}$ fatty alcohol or acid hydrophobes condensed with from 2 to 100 moles of ethylene oxide or propytene oxide per mole of hydrophobe; $C_2$-$C_{10}$ alkyl phenols condensed with from 2 to 20 moles of alkylene oxides; mono- and di- fatty acid esters of ethylene glycol such as ethylene glycol distearate; fatty acid monoglycerides; sorbitan mono- and di- $C_8$-$C_{20}$ fatty acids; and polyoxyethylene sorbitan available as Polysorbate 80 and Tween 80® as well as combinations of any of the above surfactants.

Other useful nonionic surfactants include alkyl polyglycosides (APGs), saccharide fatty amides (e.g. methyl gluconamides) as well as long chain tertiary amine oxides. Examples of the latter category are: dimethyldodecylamine oxide, oleyldi(2-hydroxyethyl)amine oxide, dimethyloctylamine oxide, dimethyldecylamine oxide, dimethyltetradecylamine oxide, di(2-hydroxyethyt)tetradecylamine oxide, 3-didodecyloxy-2-hydroxypropyldi(3-hydroxypropyl) amine oxide, and dimethylhexadecylamine oxide.

Illustrative but not limiting examples of anionic surfactants include the following:

(1) Alkyl benzene sulfonates in which the alkyl group contains from 9 to 15 carbon atoms, preferably 11 to 14 carbon atoms in straight chain or branched chain configuration. Especially preferred is a linear alkyl benzene sulfonate containing about 12 carbon atoms in the alkyl chain.

(2) Alkyl sulfates obtained by sulfating an alcohol having 8 to 22 carbon atoms, preferably 12 to 16 carbon atoms. The alkyl sulfates have the formula $ROSO_3$-$M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety.

(4) Olefin sulfonates having 8 to 22 carbon atoms, preferably 12 to 16 carbon atoms. Most preferred is sodium $C_{14}$-$C_{16}$ olefin sulfonate, available as Bioterge AS 40®.

(5) Alkyl ether sulfates derived from an alcohol having 8 to 22 carbon atoms, preferably 12 to 16 carbon atoms, ethoxylated with less than 30, preferably less than 12, moles of ethylene oxide. Most preferred is sodium lauryl ether sulfate formed from 2 moles average ethoxylation, commercially available as Standopol ES-2®.

(6) Alkyl glyceryl ether sulfonates having 8 to 22 carbon atoms, preferably 12 to 16 carbon atoms, in the alkyl moiety.

(7) Fatty acid ester sulfonates of the formula: $R^1CH(SO_3$-M+)CO2$R^2$ where $R^1$ is straight or branched alkyl from about $C_8$ to $C_{18}$, preferably $C_{12}$ to $C_{16}$, and $R^2$ is straight or branched alkyl from about $C_1$ to $C_6$, preferably primarily $C_1$, and M+ represents a mono- or divalent cation.

(8) Secondary alcohol sulfates having 6 to 18, preferably 8 to 16 carbon atoms.

(9) Fatty acyl isethionates having from 10 to 22 carbon atoms, with sodium cocoyl isethionate being preferred.

(10) Mono- and dialkyl sulfosuccinates wherein the alkyl groups range from 3 to 20 carbon atoms each.

(11) Alkanoyl sarcosinates corresponding to the formula $RCON(CH_3)CH_2CH_2CO_2M$ wherein R is alkyl or alkenyl of about 10 to about 20 carbon atoms and M is a water-soluble cation such as ammonium, sodium, potassium and trialkanolammonium. Most preferred is sodium lauroyl sarcosinate.

Illustrative of cationic surfactants are $C_8$-$C_{22}$ alkyl $C_1$-$C_4$ di-alkyl ammonium salts such as cetyl dimethyl ammonium chloride, stearyl dimethyl ammonium methosulfate, oleyl diethylammonium phosphate, and lauryl dimethyl ammonium borate. Particularly preferred is cetrimonium chloride which is a generic term for cetyl dimethyl ammonium chloride.

Amphoteric surfactants useful for the present invention include betaines which may have the general formula $RN^+(R^1)_2R^2$-$COO^-$ wherein R is a hydrophobic moiety selected from the group consisting of alkyl groups containing from 10 to 22 carbon atoms, preferably from 12 to 18 carbon atoms; alkyl aryl and aryl alkyl groups containing 10 to 22 carbon atoms with a benzene ring being treated as equivalent to about 2 carbon atoms, and similar structures interrupted by amido or ether linkages; each $R^1$ is an alkyl group containing from 1 to 3 carbon atoms; and $R^2$ is an alkylene group containing from 1 to about 6 carbon atoms. Sulfobetaines such as cocoamidopropyl hydroxysultaine are also suitable.

Examples of preferred betaines are dodecyl dimethyl betaine, cetyl dimethyl betaine, dodecyl amidopropyidimethyl betaine, tetradecytdimethyt betaine, tetradecylamidopropytdimethyl betaine, and dodecyidimethylammonium hexanoate. Most preferred is cocoamidopropyt betaine available as Tegobetaine F® sold by Th. Goldschmidt AG of Germany.

Polyols are frequently present in the water phase of the present invention. Typical polyhydric alcohols include glycerol (also known as glycerin), polyalkylene glycols and more preferably alkytene polyots and their derivatives, including propylene glycol, dipropylene glycot, polypropylene glycol, polyethylene glycol and derivatives thereof, sorbitol, hydroxypropyl sorbitol, hexylene glycol, butylene glycol, 1,2,5-hexanetriol, ethoxylated glycerol, propoxytated glycerol and mixtures thereof. Most preferred is glycerin. Amounts of the polyols may range from about 0.5 to about 50%, preferably between about 1 and about 15% by weight of the total personal care composition.

Thickeners/viscosifiers in amounts from about 0.01 to about 10% by weight of the total personal care composition may also be included in the first water phase and/or in a separate fourth phase. As known to those skilled in the art, the precise amount of thickeners can vary depending upon the consistency and thickness of the composition which is desired. Exemplary thickeners are xanthan gum, sodium carboxymethyl cellulose, hydroxyalkyl and alkyl celluloses (particularly hydroxypropyl cellulose), and cross-linked acrylic acid polymers such as those sold by B.F. Goodrich under the Carbopol trademark. Thickeners such as modified starches and clays may also be used to thicken the water phase. For instance, aluminum starch octenyl succinate (available as DryFlo® from the National Starch and Chemical Company) is particularly useful. Among the clays are included magnesium aluminum silicate (available as Veegum®), hectorite clays, montmorillonite clays, bentonites (e.g. Bentone® 38) and combinations thereof.

Water soluble conditioning agents may also be incorporated into the water phase. Cationic agents in monomeric and polymeric form are particularly useful for this purpose. Cationic cellulose derivatives, cationic starches, copolymers of a diallyl quaternary ammonium salt and an acrylamide, quaternized vinylpyrrolidone vinylimidazole polymers, polyglycol amine condensates, quaternized collagen polypeptide, polyethylene imine, cationized silicone polymer (e.g. Amodimethicone), cationic silicone polymers provided in a mixture with other components under the trademark Dow Corning 929 (cationized emulsion), copolymers of adipic acid and dimethylaminohydroxypropyl diethylenetriamine, cationic chitin derivatives, cationized guar gum (e.g. Jaguar® C-B-S, Jaguar® C-17, and Jaguar® C-16) and quaternary ammonium salt polymers (e.g. Mirapol® A-15, Mirapol® AD-1, Mirapol®, ZA-1, etc., manufactured by the Miranol Division of the Rhone Poulenc Company). Examples of the monomeric cationic conditioning agents are salts of the general structure:

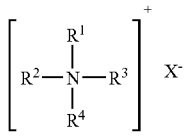

wherein $R^1$ is selected from an alkyl group having from 12 to 22 carbon atoms, or aromatic, aryl or alkaryl groups having from 12 to 22 carbon atoms; $R^2$, $R^3$, and $R^4$ are independently selected from hydrogen, an alkyl group having from 1 to 22 carbon atoms, or aromatic, aryl or alkaryl groups having from 12 to 22 carbon atoms; and $X^-$ is an anion selected from chloride, bromide, iodide, acetate, nitrate, sulfate, methyl sulfate, ethyl sulfate, tosylate, lactylate, citrate, glycolate, and mixtures thereof. Additionally, the alkyl groups can also contain either linkages or amino group substituents (e.g., the alkyl groups can contain polyethylene glycol and polypropylene glycol moieties).

Compositions of the present invention that are emulsions may be oil-in-water or water-in-oil, although the former is preferred. Relative weight ratios of water to oil phases of the emulsion may range from about 1,000:1 to about 1:10, preferably from about 100:1 to about 1:5, optimally from about 10:1 to about 1:2 by weight of the total personal care composition.

Another component often present in the first water phase and sometimes in the other water phase(s) are preservatives. These are incorporated to protect against the growth of potentially harmful microorganism. Suitable traditional preservatives are EDTA salts and alkyl ester of parahydroxybenzoic acid. Other preservatives which have more recently come into use include hydantoin derivatives, propionate salts, and a variety of quaternary ammonium compounds. Cosmetic chemists are familiar with appropriate preservatives and routinely choose them to satisfy the preservative challenge test and to provide product stability. Particularly preferred preservatives are iodopropynyl butyl carbamate, phenoxyethanol, methyl paraben, propyl paraben, imidazolidinyl urea, sodium dehydroacetate and benzyl alcohol. The preservatives should be selected having regard for the use of the composition and possible incompatabilities between the preservatives and other ingredients in the composition. Preservatives are employed in amounts ranging from 0.01% to 2% by weight of the total personal care composition.

The second phase when an oil phase will contain hydrophobic components. Most often the oil phase will incorporate an emollient which may be selected from hydrocarbons, silicones and synthetic or vegetable esters. Amounts of the emollients may range anywhere from about 0.1 to about 30%, preferably between about 0.5 and about 10% by weight of the total personal care composition.

Hydrocarbons suitable for the present invention include isoparaffins, mineral oil, petrolatum and hydrocarbon waxes such as polyethylenes.

Silicones may be divided into the volatile and non-volatile variety. The term "volatile" as used herein refers to those materials which have a measurable vapor pressure at ambient temperature. Volatile silicone oils are preferably chosen from cyclic or linear polydimethylsiloxanes containing from about 3 to about 9, preferably from about 4 to about 5, silicone atoms.

Nonvolatile silicones useful as an emollient material include polyalkyl siloxanes, polyalkylaryl siloxanes and polyether siloxane copolymers. The essentially non-volatile polyalkyl siloxanes useful herein include, for example, polydimethyl siloxanes with viscosities of from about 5 to about 100,000 centistokes at 25° C.

Among suitable ester emollients are:

(1) Alkenyl or alkyl esters of fatty acids having 10 to 20 carbon atoms. Examples thereof include isopropyl; palmitate, isononyl isononoate, oleyl myristate, oleyl stearate, cetearyl stearate and oleyl oleate.

(2) Ether-esters such as fatty acid esters of ethoxylated fatty alcohols.

(3) Polyhydric alcohol esters. Ethylene glycol mono- and di-fatty acid esters, diethylene glycol mono- and di-fatty acid esters, polyethylene glycol (200-6000) mono- and di-fatty acid esters, propylene glycol mono- and di-fatty acid esters, polypropylene glycol 2000 monooleate, polypropylene glycol 2000 monostearate, ethoxylated propylenbe glycol monostearate, glyceryl mono- and di-fatty acid esters, polyglycerol fatty esters, ethoxylated glyceryl monostearate, 1,3-butylene glycol monostearate, 1,3-butylene glycol distearate, polyoxyethylene polyol fatty acid ester, sorbitan fatty acid esters, and polyoxyethylene sorbitan fatty acid esters are satisfactory polyhydric alcohol esters.

(4) Wax esters such as beeswax, spermaceti, myristyl myristate, stearyl stearate.

(5) Steroid esters, of which soya sterol and cholesterol fatty acid esters are examples thereof.

Most preferred vegetable ester emollients are sunflower seed oil, soy sterol esters, borage seed oil, maleated soybean oil, sucrose polycottonseedate, tribehenin, sucrose polybehenate and mixtures thereof.

Fatty acids may also be included in the oil phase. These fatty acids may have from 10 to 30 carbon atoms. Illustrative of this category are pelargonic, lauric, myristic, palmitic, stearic, isostearic, hydroxystearic, oleic, linoleic, ricinoleic, arachidic, behenic and erucic acids. Amounts may range from 0.1 to 25% by weight of the total personal care composition.

Fragrances, colorants and promotional ingredients may also be included in the oil and either of the water phases. Colorants illustrative of the present invention include Red No. 4, Red No. 40 and the FD&C colorants Red No. 3, Red No. 6, Red No. 28, Red No. 33, Blue No. 1, Green No. 5, Yellow No. 5, all the foregoing being water soluble. Oil soluble dyes may also be utilized such as Green No. 6 and D&C Violet No. 2. Active levels of these colorants may range from about 0.0001 to about 1%, preferably from about 0.001 to about 0.1% by weight of the total personal care composition.

The term "fragrance" is defined as a mixture of odoriferous components, optionally mixed with a suitable solvent diluent or carrier, which is employed to impart a desired odor.

Fragrance components and mixtures thereof may be obtained from natural products such as essential oils, absolutes, resinoids, resins and concretes, as well as synthetic products such as hydrocarbons, alcohols, aldehydes, ketones, ethers, carboxylic acids, esters, acetals, ketals, nitrites and the like, including saturated and unsaturated compounds, aliphatic, carbocyclic and heterocyclic compounds.

Suitable solvents, diluents or carriers for fragrance ingredients as mentioned above are for example: ethanol, isopropanol, diethylene glycol monoethyl ether, dipropyl glycol and triethyl citrate.

Particularly preferred fragrance ingredients are cyclic and acyclic terpenes and terpenoids. These materials are based upon isoprene repeating units. Examples include alpha and beta pinene, myrcene, geranyl alcohol and acetate, camphene, dl-limonene, alpha and beta phellandrene, tricyclene, terpinolene, allocimmane, geraniol, nerol, linanool, dihydrolinanool, citral, ionone, methyl ionone, citronetlol, citronellat, alpha terpineol, beta terpineol, alpha fenchol, borneol, isoborneol, camphor, terpinen-1-ol, terpin-4-ol, dihydroterpineol, methyl chavicol, anethole, 1,4 and 1,8 cineole, geranyl nitrile, isobornyl acetate, linatyl acetate, caryophyllene, alpha cedrene, guaiol, patchouli alcohol, alpha and beta santatol and mixtures thereof.

Amounts of the fragrance may range from about 0.00001 to about 2%, preferably from about 0.0001 to about 1%, optimally from about 0.01 to about 0.5%, most preferably from about 0.05 to about 0.25% by weight of the personal care composition.

Vitamins are illustrative of promotional ingredients. These include Vitamin A (retinol), Vitamin A derivatives (retinyt palmitate, retinyl linoleate, retinyl acetate and retinoic acid), Vitamin C, Vitamin C derivatives (such as ascorbyl tetraisopalmitate and magnesium ascorbyl phosphate), Vitamin E, Vitamin E derivatives (such as tocopherol acetate), biotin, niacin and DL-panthenol and combinations thereof.

Amounts of the promotional ingredients may range from about 0.00001 to about 2%, preferably from about 0.0001 to about 1%, optimally from about 0.001 to about 0.5% by weight of the total personal care composition.

The combined first and third water phases may constitute from about 5 to about 99.5%, preferably from about 20 to about 90%, more preferably from about 35 to about 80%, optimally from about 45 to about 70% by weight of the final personal care composition.

The combined first and third water phases will contain water as a major component. Usually the amount of water may range from about 30 to about 99.9%, preferably from about 50 to about 95%, more preferably from about 65 to about 80%, optimally from about 55 to about 70% by weight of the combined first and third water phases.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

Except in the operating and comparative examples, or where otherwise explicitly indicated, all numbers in this description indicating amounts of material ought to be understood as modified by the word "about".

The following examples will more fully illustrate the embodiments of this invention. All parts, percentages and proportions referred to herein and in the appended claims are by weight unless otherwise illustrated.

EXAMPLE 1

A pair of skin lotions are prepared to reflect a 2× and a 10× level of concentrate. Both concentrates with the appropriate amount of added water will attain the resultant composition shown in Table I.

TABLE I

| Phase | Ingredient Name | Resultant Composition (2 Stream) | 2X (3 Stream) | 10X (4 Stream) |
|---|---|---|---|---|
| Oil | Stearic Acid | 2.0217 | 2.0217 | 2.0217 |
| | Glycol Stearate/ Stearamide AMP | 1.1939 | 1.1939 | 1.1939 |
| | Glycerol Monostearate | 0.5572 | 0.5572 | 0.5572 |
| | Cetyl Alcohol | 0.3184 | 0.3184 | 0.3184 |
| | Petrolatum | 0.5 | 0.5 | 0.5 |
| | Mineral Oil | 1.4 | 1.4 | 1.4 |
| | Dimethicone | 0.3 | 0.3 | 0.3 |
| Water | Water | 79.4078 | 32.5534 | 3.1699 |
| | Tetrasodium EDTA | 0.1017 | 0.1017 | 0.1017 |
| | Magnesium Aluminum Silicate | 0.2 | 0.2 | 0.2 |
| | Glycerin | 3.5 | 3.5 | 3.5 |
| | Methylparaben | 0.1425 | 0.1425 | 0.1425 |
| | Titanium Dioxide (Water Dispersible) | 0.1 | 0.1 | 0.1 |
| | Carbopol 934 ® (2% Active in Water) | 9 | 9 | 0 |
| | Triethanolamine | 0.7568 | 0.7568 | 0.7568 |
| | Aloe Vera Gel | 0.09 | 0.09 | 0.09 |
| | DMDM Hydantoin | 0.25 | 0.25 | 0.25 |
| | Fragrance | 0.16 | 0.16 | 0.16 |
| Water Only | | — | 46.8544 | 76.2379 |
| Carbopol ® 934 Only | | — | — | 9 |

The oil and water phases are each separately contained in respective first and second tanks. With the aid of a progressive cavity pump (ex Moyno/Seepex), these phases are separately fed through pipes to a blending tube antechamber section of a Sonolator®. The combined flow rate is precisely maintained at 20 lbs./minutes at 200 psi. The water phase concentrate is held at a temperature between 24 and 52° C. with capacity of the tank being 3,000 gallons. The oil phase is held at a temperature from 65 to 93° C. in a 250 gallon tank.

From a third tank, the 2× concentrate experiment delivers a third stream which is pure water regulated at the same pressure as that of the first water and oil phases. The pure water phase is maintained at 15 to 38° C. and pumped into the blending tube antechamber of the Sonolator®. All phases are then homogenized together in the Sonolator® at 500 psi. Thereafter the combined streams are sent to a storage vessel where resultant product is held at 24 to 44° C. Some of the resultant skin lotion composition is pumped by a positive displacement pump as a return stream into the blending tube of the Sonolator®. Amount of this return flow is approximately 5% for purposes of a new start-up or as re-work product. Remainder of the composition held within the storage vessel is sent to a packaging line for fill into empty bottles.

The 10× concentrate employs a fourth stream of water/thickener (Carbopol 934®). This fourth stream is pumped at similar pressure and flow rate (proportioned to its proportion in the final composition) into the blending tube antechamber of the Sonolator®. All other processing is identical to that described above for the 2× concentrate.

EXAMPLE 2

A set of dry skin remediating lotions are prepared to reflect a 2×, 4× and 6× level of concentrates. All three concentrates with the appropriate amount of added water will attain the resultant composition shown in Table II.

TABLE II

| Phase | Ingredient Name | Resultant Composition (2 Stream) | 2X (3 Stream) | 4X (3 Stream) | 6X (3 Stream) |
|---|---|---|---|---|---|
| Oil | Stearic Acid | 2.54 | 2.54 | 2.54 | 2.54 |
| | Glycol Stearate/Stearamide AMP | 1.5 | 1.5 | 1.5 | 1.5 |
| | Glycerol Monostearate | 0.7 | 0.7 | 0.7 | 0.7 |
| | Cetyl Alcohol | 0.4 | 0.4 | 0.4 | 0.4 |
| | Sunflower Seed Oil | 1.25 | 1.25 | 1.25 | 1.25 |
| | Silicone Fluid 200 | 0.26 | 0.26 | 0.26 | 0.26 |
| | Soy Sterol | 0.08 | 0.08 | 0.08 | 0.08 |
| | Vitamin E Acetate | 0.01 | 0.01 | 0.01 | 0.01 |
| | Lecithin | 0.04 | 0.04 | 0.04 | 0.04 |
| | Sodium Stearoyl Lactylate | 0.1 | 0.1 | 0.1 | 0.1 |
| | Petrolatum | 0.9375 | 0.9375 | 0.9375 | 0.9375 |
| | Methyl Palmitate | 0.3125 | 0.3125 | 0.3125 | 0.3125 |
| Water | Water | 81.6605 | 35.7205 | 12.7605 | 5.1005 |
| | Glycerin | 5.5 | 5.5 | 5.5 | 5.5 |
| | Disodium EDTA | 0.05 | 0.05 | 0.05 | 0.05 |
| | Mineral Blend | 0.001 | 0.001 | 0.001 | 0.001 |
| | Magnesium Aluminum Silicate | 0.2 | 0.2 | 0.2 | 0.2 |
| | Oat Protein | 0.001 | 0.001 | 0.001 | 0.001 |
| | Methylparaben | 0.1425 | 0.1425 | 0.1425 | 0.1425 |
| | Titanium Dioxide (Water Dispersible) | 0.1 | 0.1 | 0.1 | 0.1 |
| | Carbopol 934 ® (2% Active) | 3 | 3 | 3 | 3 |
| | Triethanolamine | 0.813 | 0.813 | 0.813 | 0.813 |
| | DMDM Hydantoin | 0.25 | 0.25 | 0.25 | 0.25 |
| | Fragrance | 0.15 | 0.15 | 0.15 | 0.15 |
| | Vitamin A Palmitate | 0.001 | 0.001 | 0.001 | 0.001 |
| | Keratin | 0.001 | 0.001 | 0.001 | 0.001 |
| | Total | 91.87 | | | 15.31 |
| Water Only | | — | 45.94 | 68.9 | 76.56 |

The oil and water phases are each separately contained in respective first and second tanks. With the aid of a progressive cavity pump (ex Moyno/Seepex), these phases are separately fed through pipes to a blending tube antechamber section of a Sonolator®. The combined flow rate is precisely maintained at 50 lbs./minutes at 800 psi. The water phase concentrate is held at a temperature between 24 and 52° C. with capacity of the tank being 5,000 gallons. The oil phase is held at a temperature from 65 to 93° C. in a 250 galton tank.

From a third tank, the 2× concentrate experiment delivers a third stream which is pure water regulated at the same pressure as that of the first water and oil phases. The pure water phase is maintained at 15 to 38° C. and pumped into the blending tube antechamber of the Sonolator®. All phases are then homogenized together in the Sonotator® at 1000 psi. Thereafter the combined streams are sent to a storage vessel where resultant product is held at 24 to 44° C. Some of the resultant dry skin lotion composition is pumped by a positive displacement pump as a return stream into the blending tube of the Sonotator®. Amount of this return flow is approximately 5% for purposes of a new start-up or as re-work product. Remainder of the composition held within the storage vessel is sent to a packaging line for fill into empty bottles.

Processing for the 4× and 6× concentrates is identical to that described above for the 2× concentrate.

EXAMPLE 3

A set of shampoo formulations are prepared to reflect a 2×, 4× and 8× level of concentrates. All three concentrates with the appropriate amount of added water will attain the resultant composition shown in Table III.

TABLE III

| Phase | Ingredient Name | Resultant Composition (2 Stream) | 2X (3 Stream) | 4X (3 Stream) | 8X (3 Stream) |
|---|---|---|---|---|---|
| Water | Water | 79.5278 | 38.5288 | 18.0278 | 7.7768 |
| | Fragrance | 0.5000 | 0.5000 | 0.5000 | 0.5000 |
| | D&C RED #33 | 0.0002 | 0.0002 | 0.0002 | 0.0002 |
| | Vitamin E Acetate | 0.0010 | 0.0010 | 0.0010 | 0.0010 |
| | Rasberry Extract | 0.0010 | 0.0010 | 0.0010 | 0.0010 |
| | Citric Acid (50% Active) | 0.0300 | 0.0300 | 0.0300 | 0.0300 |
| | Hydroxypropyl-methylcellulose | 0.1500 | 0.1500 | 0.1500 | 0.1500 |
| | Tetrasodium EDTA | 0.2000 | 0.2000 | 0.2000 | 0.2000 |
| | Glydant ® | 0.1000 | 0.1000 | 0.1000 | 0.1000 |
| | Kathon CG ® | 0.0400 | 0.0400 | 0.0400 | 0.0400 |
| | Benzophenone-4 | 0.0500 | 0.0500 | 0.0500 | 0.0500 |
| | Ammonium Chloride | 1.4000 | 1.4000 | 1.4000 | 1.4000 |
| Oil | | 18 | 18 | 18 | 18 |
| Water Only | | — | 40.999 | 61.5000 | 71.7510 |

Processing of the shampoo is performed in a manner similar to that described under Example 2.

EXAMPLE 4

A set of hair conditioners is prepared to reflect a 2×, 4× and 8× level of concentrates. All the concentrates with the appropriate amount of added water will attain the resultant composition shown in Table IV.

TABLE IV

| Phase | Ingredient Name | Resultant Composition (2 Stream) | 2X (3 Stream) | 4X (3 Stream) | 8X (3 Stream) |
|---|---|---|---|---|---|
| Water | Water | 73.486 | 32.171 | 11.514 | 1.185 |
| | Cocamidopropyl Betaine | 6.028 | 6.028 | 6.028 | 6.028 |
| | Aloe Vera Powder | 0.005 | 0.005 | 0.005 | 0.005 |
| | Benzophenone-4 | 0.100 | 0.100 | 0.100 | 0.100 |
| | Glycerin | 1.000 | 1.000 | 1.000 | 1.000 |
| | PEG-10 Sunflower Seed Oil | 0.100 | 0.100 | 0.100 | 0.100 |
| | Tetrasodium EDTA | 0.051 | 0.051 | 0.051 | 0.051 |
| | Sodium Hydroxide (50% Aqueous) | 0.048 | 0.048 | 0.048 | 0.048 |
| | Ammonium Chloride | 0.325 | 0.325 | 0.325 | 0.325 |
| | Kathon CG ® | 0.020 | 0.020 | 0.020 | 0.020 |
| | Fragrance | 1.000 | 1.000 | 1.000 | 1.000 |
| | Color Sol. Ext Violet #2 (0.2%) | 0.333 | 0.333 | 0.333 | 0.333 |
| | Vitamin E Acetate | 0.001 | 0.001 | 0.001 | 0.001 |
| | Dequest 2010 ® | 0.033 | 0.033 | 0.033 | 0.033 |
| | Polyquaternium-10 | 0.100 | 0.100 | 0.100 | 0.100 |
| | | 82.630 | | | |
| Oil | | 17.37 | 17.37 | 17.37 | 17.37 |
| Water Only | | — | 41.315 | 61.973 | 72.301 |

All of the processing is identical to that described under Example 2 for the respective concentrates.

What is claimed is:

1. A process for manufacture of personal care compositions comprising:

(i) separately feeding a first water phase which is a concentrate comprising more than 15% by weight of the first water phase of ingredients other than water and having a viscosity from about 50 to about 30,000 cps into a blending tube of a sonic mixer;

(ii) separately feeding a second phase into the blending tube, the first phase entering the blending tube being at least 10° F. lower in temperature than that of the second phase entering the blending tube;

(iii) separately feeding a third phase comprising no more than 2% by weight of the third phase of ingredients other than water having a viscosity of less than 30 cps into the blending tube, the third phase being at least about 15% of the composition;

(iv) sonically mixing together all three of the phases, in the blending tube as a liquid stream at a pressure from about 10 to about 5,000 psi and at a flow rate of about 5 to about 5,000 pounds per minute, steps (i) through (iv) being performed in a continuous manner; and (v) recovering a resultant mixture as a personal care composition.

2. The process according to claim 1 wherein the first phase comprises more than 40% by weight of the first phase of ingredients other than water.

3. The process according to claim 1 wherein the first phase and the third phase are fed to the blending tube at a relative weight ratio of about 1:1 to about 1:40.

4. The process according to claim 1 wherein the first phase and the third phase are fed to the blending tube at a relative weight ratio of about 1:1 to about 1:10.

5. The process according to claim 1 wherein the third phase consists essentially of water.

6. The process according to claim 1 wherein the blending tube has a volume ranging from about 0.0001 to about 100 cubic inches.

7. The process according to claim 1 wherein the blending tube has a volume ranging from about 0.01 to about 5 cubic inches.

8. The process according to claim 1 wherein the second phase is an oil phase.

9. The process according to claim 1 wherein first, second and third phases are pumped into the tube at a pressure ranging from about 150 to about 1,000 psi.

10. The process according to claim 1 wherein the flow rate ranges from about 150 to about 800 pounds per minute.

* * * * *